US012370593B2

(12) United States Patent
Zhao et al.

(10) Patent No.: US 12,370,593 B2
(45) Date of Patent: Jul. 29, 2025

(54) COUNTER-ROLLER ACTIVE POWER FLEXIBLE SPINNING DEVICE FOR LARGE CYLINDER

(71) Applicant: Xi'an Jiaotong University, Xi'an (CN)

(72) Inventors: Shengdun Zhao, Xi'an (CN); Fan Li, Xi'an (CN); Yuxing Shen, Xi'an (CN); Ruigeng Yang, Xi'an (CN); Hongzhong Xu, Xi'an (CN); Baiyang Liu, Xi'an (CN)

(73) Assignee: XI'AN JIAOTONG UNIVERSITY, Xi'an (CN)

( * ) Notice: Subject to any disclaimer, the term of this patent is extended or adjusted under 35 U.S.C. 154(b) by 172 days.

(21) Appl. No.: 18/321,260

(22) Filed: May 22, 2023

(65) Prior Publication Data

US 2024/0226983 A1 Jul. 11, 2024

(30) Foreign Application Priority Data

Jan. 9, 2023 (CN) ..... 202310026841.9

(51) Int. Cl.
*B21D 22/18* (2006.01)

(52) U.S. Cl.
CPC ..... *B21D 22/18* (2013.01)

(58) Field of Classification Search
CPC ..... B21D 22/14; B21D 22/16; B21D 22/18; B21D 22/185; B21D 37/10
USPC ..... 72/80, 110
See application file for complete search history.

(56) References Cited

U.S. PATENT DOCUMENTS 4,766,752 A * 8/1988 Gronert ..... B21D 22/14 72/110
11,292,045 B2 * 4/2022 Zhao ..... B21D 22/14
2009/0293688 A1 * 12/2009 Nillies ..... B21D 22/18 82/122

OTHER PUBLICATIONS

CN 109201829A, Wang et al. Jan. 2019.*
CN 110479833A, Zhao et al. Nov. 2019.*
CN 111014410A, Zhao et al. Apr. 2020.*
CN 115229017A, Zhang et al. Oct. 2022.*
CN 104668329A, An et al. Jun. 2015.*
CN 106311910A, Li et al. Jan. 2017.*

* cited by examiner

*Primary Examiner* — Edward T Tolan
(74) *Attorney, Agent, or Firm* — Boisbrun Hofman, PLLC

(57) ABSTRACT

Disclosed is a counter-roller active power flexible spinning device for a large cylinder, including a rack unit, a spindle unit, an outer roller unit, and an inner roller unit. A spindle turntable of the spindle unit is used to fix a cylinder blank. A second driver drives the spindle turntable to rotate, thereby achieving the rotation of a cylinder blank. A first driver drives the spindle turntable to be axially fed along a cylinder through a spindle platform. A third driver of the outer roller unit can drive an outer roller to rotate, and a fourth driver drives an outer roller seat to be radially fed along the cylinder at the top of an outer pillar. A fifth driver of the inner roller unit can drive an inner roller to rotate, and a sixth driver drives an inner roller seat to be radially fed along an inner roller disk.

18 Claims, 11 Drawing Sheets

COUNTER-ROLLER ACTIVE POWER FLEXIBLE SPINNING DEVICE FOR LARGE CYLINDER

CROSS-REFERENCE TO RELATED APPLICATIONS

This patent application claims the benefit and priority of Chinese Patent Application No. 202310026841.9, titled "COUNTER-ROLLER ACTIVE POWER FLEXIBLE SPINNING DEVICE FOR LARGE CYLINDER," filed with the China National Intellectual Property Administration on Jan. 9, 2023, the disclosure of which is incorporated by reference herein in its entirety as part of the present application.

TECHNICAL FIELD

The present disclosure relates to the technical field of power spinning forming device and its peripheral supporting facilities, in particular to a counter-roller active power flexible spinning device for a large cylinder.

BACKGROUND OF THE DISCLOSURE

As important supporting and storage structural parts, large cylinders are widely used in important industrial fields such as aerospace, weapons and military industry, petrochemical transportation and shipbuilding. Such parts have strict requirements on machining technology and manufacturing device. Power spinning technology is the most advantageous technology for manufacturing large seamless cylinders with high precision and high quality at present.

In the traditional mandrel power spinning technology, the blank is sleeved outside the mandrel in the forming process. After the blank and mandrel rotate along with the spindle, the roller axially moves along the mandrel after being radially fed to a given position along the blank, and then gradually squeezes the blank to achieve cylinder forming.

In the counter-roller power spinning technology, the inner roller is used instead of the mandrel to process the inner and outer surfaces of the blank at the same time. The positions of the inner and outer rollers can be adjusted according to the blank size, so as to achieve the processing of different specifications of cylinders. The inventor has proposed a counter-roller active power flexible spinning technology, which is a new technology combining a skew rolling technology on the basis of the counter-roller power spinning, and applying a power source on the inner and outer rollers to make the inner and outer rollers rotate actively to cooperate with the spindle for cylinder processing.

At present, the existing power spinning technology and device have certain shortcomings in processing large thin-walled cylinders: (1) the inner and outer surfaces of the cylindrical workpiece after traditional mandrel power spinning have inconsistent performance, the large-diameter mandrel has large inertia and high cost, and thus the mandrel is not suitable for the processing and manufacturing of large and super-large cylinders. (2) As the inner roller is used instead of the mandrel in the counter-roller power spinning technology, the cylinder is easy to lose stability in the machining process due to the loss of the mandrel supporting, resulting in limited wall thickness reduction rate during single-pass power spinning. (3) Four-counter-roller power spinning device (U.S. Pat. Nos. 4,766,752, 4,951,490) is designed and manufactured by MT Company of Germany. During the processing of the device, the cylindrical workpiece rotates with the center line of the spindle, and the inner and outer rollers move along the axial and radial directions of the cylinder, respectively. The inner and outer rollers and the roller racks are required to be respectively designed and provided with corresponding power components and transmission systems, leading to complex structure and high requirements for processing and assembly accuracy. It is difficult to synchronously control the inner and outer rollers in axial movement. In addition, the inner and outer rollers of the device are fed by using a wedge self-locking mechanism, so the inner and outer rollers cannot be fed during the processing. (4) The inventor has proposed counter-roller active power spinning device (CN110479837B, U.S. Pat. No. 11,292,045B2). Both inner and outer rollers are under cylindrical guidance, and the rigidity of the device is poor. Moreover, the radial feeding of the inner roller of the device is adjusted by a small stepping motor, the inner roller cannot be fed during the processing, and the overall processing flexibility is insufficient. In addition, the inner roller of the device cannot rotate actively and thus cannot match with the active rotation of the outer roller.

SUMMARY OF THE DISCLOSURE

An objective of the present disclosure is to provide a counter-roller active power flexible spinning device for a large cylinder, so as to solve the problems existing in the prior art and improve the processing accuracy of a large thin-walled cylindrical part.

To achieve the objective above, the present disclosure provides the following solution: a counter-roller active power flexible spinning device for a large cylinder is provided, including: a rack unit, including a base, inner pillars, outer pillars, and an inner roller disk, where the inner pillars and the outer pillars are both connected to the base, a distance between each outer pillar and the center of the base is greater than that between each inner pillar and the center of the base, and the inner roller disk is connected to one end, far away from the base, of each inner pillar; a spindle unit, including a spindle platform, a spindle turntable, a first driver, second drivers, and workpiece fixtures, where the spindle platform is slidably connected to the inner pillars, the first driver is fixed onto the base, an output end of the first driver is in transmission connection with the spindle platform, the spindle turntable is rotatably connected to the spindle platform, the second drivers are fixed onto the spindle platform, output ends of the second drivers are in transmission connection with the spindle turntable, the workpiece fixtures are arranged on the spindle turntable, and the workpiece fixtures can fix a blank to be formed; an outer roller unit, including outer rollers, outer roller seats, third drivers, and fourth drivers, where the outer rollers are rotatably connected to the outer roller seats, the third drivers are fixed onto the outer roller seats, and output ends of the third drivers are in transmission connection with the outer rollers; the outer roller seats are slidingly arranged on the outer pillars; a reciprocating sliding direction of each outer roller seat is perpendicular to the rotation axis of the spindle turntable, and an extension line of a sliding route of each outer roller seat has an intersection point with the axis of the spindle turntable; the fourth drivers are fixed onto the outer pillars, and output ends of the fourth drivers are in transmission connection with the outer roller seats; an inner roller unit, including an inner roller, an inner roller seat, a fifth driver, and a sixth driver, where the inner roller is rotatably connected to the inner roller seat, the fifth driver is fixed onto the inner roller seat, an output end of the fifth driver is in transmission connection with the inner roller, and the inner roller is in one-to-one correspondence with the outer roller; the inner roller seat is slidingly arranged on the inner roller disk; a reciprocating sliding direction of the inner roller seat is perpendicular to the rotation axis of the spindle turntable, and an extension line of a sliding route of the inner roller seat has an intersection point with the axis of the spindle turntable, the sixth driver is fixed onto the inner roller disk, and an output end of the sixth driver is in transmission connection with the inner roller seat.

Preferably, the spindle platform is slidingly sleeved outside the inner pillars, and a sliding bearing is provided between the spindle platform and each inner pillar. A spindle propulsion screw is connected to the first driver, and the spindle propulsion screw is rotatably provided between the base and the inner roller disk. A spindle propulsion nut is connected to the spindle platform, and the spindle propulsion screw is in threaded connection with the spindle propulsion nut.

Preferably, one side, close to the inner pillar, of each outer pillar is provided with a slide rail, the spindle platform is provided with a slider in fit with the slide rail, and the slider is slidably arranged on the slide rail.

Preferably, a driving gear is connected to each second driver, a transmission gear is connected to the spindle turntable, the spindle turntable and the transmission gear are provided coaxially, and the driving gear is meshed with the transmission gear.

Multiple are provided, the second drivers are in one-to-one correspondence with the driving gears, and the driving gears are uniformly distributed circumferentially around the axis of the transmission gear.

Preferably, the workpiece fixtures are connected to the spindle turntable by fastening screws, and the connecting positions of the workpiece fixtures and the spindle turntable are adjustable.

Multiple workpiece fixtures are provided, and the workpiece fixtures are uniformly distributed circumferentially around the axis of the spindle turntable.

Preferably, the outer pillars are provided with U-shaped through grooves, and the outer roller seats are slidably arranged in the U-shaped through grooves. The inner roller disk is provided with U-shaped grooves in which the inner roller seats are slidably arranged, and self-lubricating copper plates are provided between the outer roller seats and the U-shaped through grooves as well as between the inner roller seats and the U-shaped grooves.

Preferably, an outer roller shaft is connected to each outer roller, and the output end of each third driver is connected to the outer roller shaft by a spline. A stop is connected to each fourth driver, and is fixed onto the outer pillar. An outer roller feeding screw is connected to the output ends of each fourth driver, an outer roller feeding nut is connected to the outer roller seat, and the outer roller feeding screw are in threaded connection with the outer roller feeding nut.

Preferably, an inner roller shaft is connected to each inner roller, and the output end of each fifth driver is connected to the inner roller shaft by a spline. An inner roller feeding worm is connected to the output end of each sixth driver, and one end, away from the sixth driver, of the inner roller feeding worm is rotatably connected to the inner roller disk. An inner roller feeding worm gear is further connected to the inner roller disk, the inner roller feeding worm gear is rotatably connected to the inner roller disk, an inner roller feeding nut is connected to the inner roller feeding worm gear, an inner roller feeding screw is connected to each inner roller seat, and the inner roller feeding screw is in threaded connection with the inner roller feeding nut.

Preferably, the rack unit further comprises an upper connecting beam and a lower connecting beam. The outer pillars are connected to the base by using the lower connecting beam, and adjacent outer pillars are connected by using the upper connecting beam. The inner pillars pass through the inner roller disk and then are fixed by fastening nuts, and the rack unit is of a cage structure.

Preferably, the counter-roller active power flexible spinning device for a large cylinder further includes balance units. Each of the balance units includes a pulley block, a steel cable and a balance weight. The pulley block is arranged on the outer pillar, one end of the steel cable is connected to the spindle platform, and the other end of the steel cable is connected to the balance weight by bypassing the pulley block.

Compared with the prior art, the present disclosure has the following technical effects:

According to the counter-roller active power flexible spinning device for the large cylinder, the spindle turntable of the spindle unit can be configured to fix the blank to be formed. The second driver drives the spindle turntable to rotate, thereby achieving the rotation of the cylinder blank. The first driver drives the spindle turntable to slide axially, and the spindle platform can drive the spindle turntable to axially move back and forth, so as to complete axial feeding. The inner pillars provide a guidance for the axial reciprocating movement of the spindle platform. The third drivers of the outer roller unit drive the outer rollers to rotate to spin the outside of the cylinder blank, and the fourth drivers drive the outer roller seats to radially slide back and forth on the outer pillars along the spindle turntable, so as to complete the radial feeding of the outer rollers. The fifth drivers of the inner roller unit can drive the inner rollers to rotate, so as to spin the inside of the cylinder blank, and the sixth drivers drive the inner roller seats to radially slide back and forth along the inner roller disk, thus performing the radial feeding of the inner rollers during the processing. The outer pillars of the rack unit provide a stable support for the outer roller unit, the inner pillars and the inner roller disk provides a mounting basis for the spindle unit and the inner roller unit, the inner pillars and the outer pillars are both connected to the base to guarantee the structural stability of the rack unit. According to the counter-roller active power flexible spinning device for the large cylinder, the axial feeding during the processing is achieved by using the spindle unit, and thus complex mechanical drive and transmission structures required by the axial movement of the inner and outer spinning parts in the prior art are avoided, the processing and assembly difficulty and the production cost of the device are reduced, the problem of high difficulty in multi-axis decentralized synchronous control is solved, and the processing accuracy of the device is improved. Meanwhile, both the outer rollers and the inner rollers can actively rotate, thus improving the force consistency of the inner and outer surfaces of the processed cylindrical part, increasing the single-pass thickness reduction rate, and avoiding the instability of the cylinder during the processing. The spindle unit, the outer roller unit and the inner roller unit are driven by separate drivers to achieve the feeding, on-line adjustment is convenient, the processing of various parts such as a variable-wall-thickness cylinder, a cylinder with circumferential ribs can be achieved, and the flexibility of the device is improved.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

DETAILED DESCRIPTION

Figure 1:
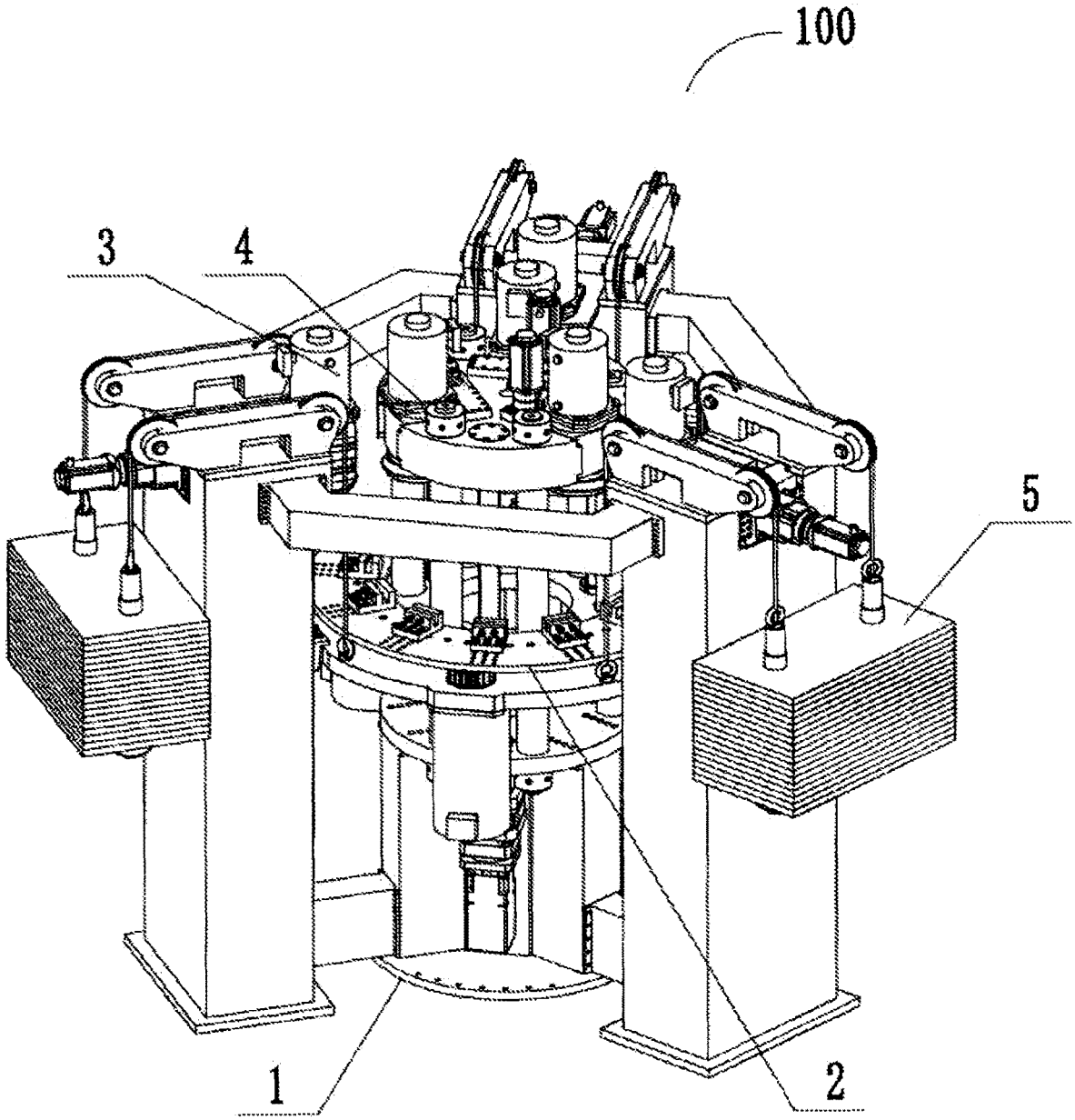
FIG. 1 is a structure schematic diagram of a counter-roller active power flexible spinning device for a large cylinder in accordance with the present disclosure.
Figure 2:
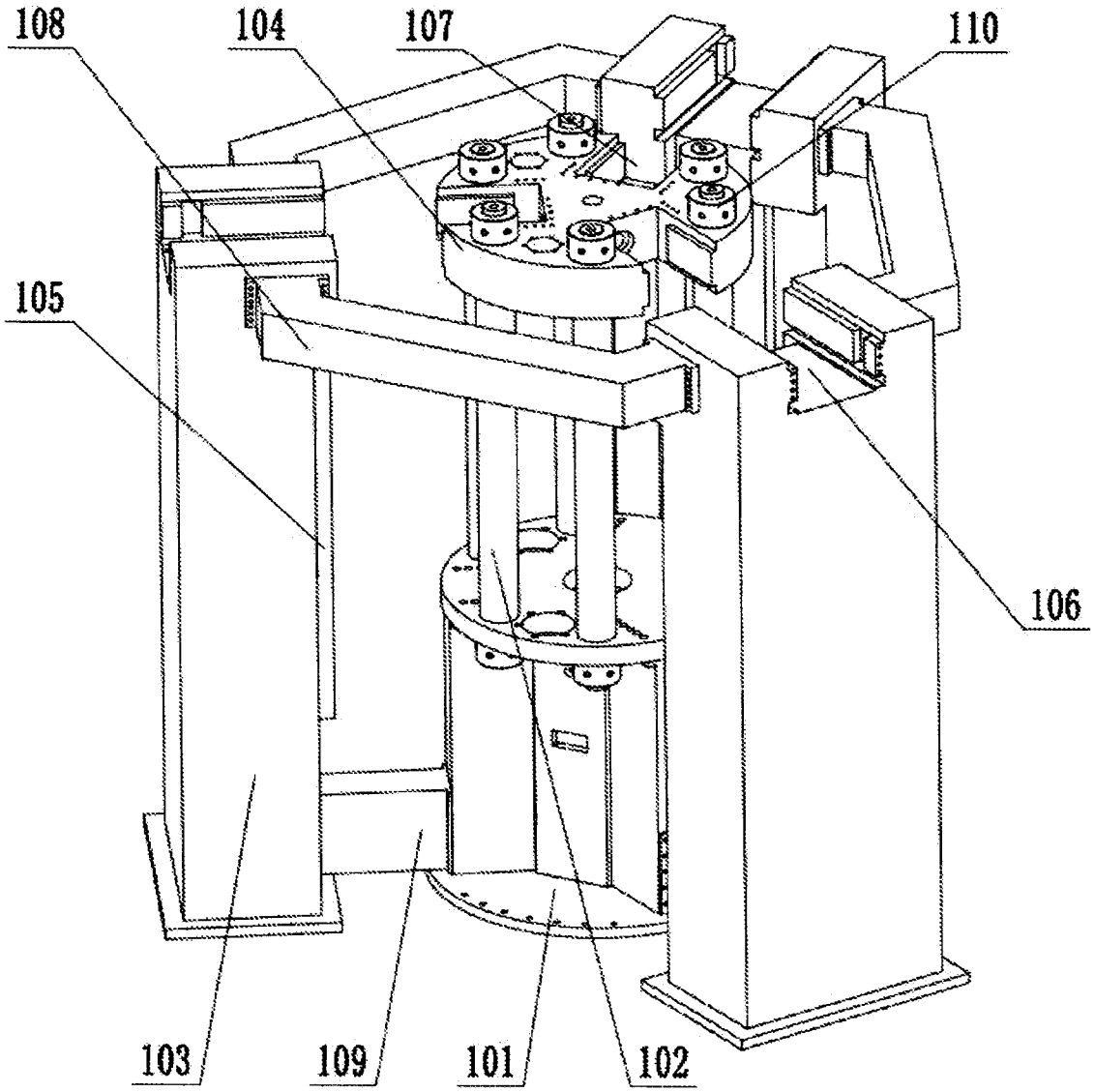
FIG. 2 is a structure schematic diagram of a rack unit of a counter-roller active power flexible spinning device for a large cylinder in accordance with the present disclosure.

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

An objective of the present disclosure is to provide a counter-roller active power flexible spinning device for a large cylinder, so as to solve the problems existing in the prior art and improve the processing accuracy of a large thin-walled cylindrical part.

To make the objectives, features and advantages of the present disclosure more apparently and understandably, the following further describes the present disclosure in detail with reference to FIGS. 1-11 showing specific embodiments according to one or more aspects of the present disclosure. Indicator numerals depicted in FIGS. 1-11 include: 100—counter-roller active power flexible spinning device for large cylinder; 1—rack unit; 101—base; 102—inner pillar; 103—outer pillar; 104—inner roller disk; 105—slide rail; 106—U-shaped through groove; 107—U-shaped groove; 108—upper connecting beam; 109—lower connecting beam; 110—fastening nut; 2—spindle unit; 201—spindle platform; 202—spindle turntable; 203—first driver; 204—second driver; 205—workpiece fixture; 206—spindle propulsion screw; 207—spindle propulsion nut; 208—slider; 209—driving gear; 210—transmission gear; 211—fastening screw; 3—outer roller unit; 301—outer roller; 302—outer roller seat; 303—third driver; 304—fourth driver; 305—outer roller shaft; 306—stop; 307—outer roller feeding screw; 308—outer roller feeding nut; 4—inner roller unit; 401—inner roller; 402—inner roller seat; 403—fifth driver; 404—sixth driver; 405—inner roller shaft; 406—inner roller feeding worm; 407—inner roller feeding worm gear; 408—inner roller feeding screw; 409—inner roller feeding nut; 410—upper cover plate; 411—lower cover plate; 5—balance unit; 501—pulley block; 502—steel cable; and 503—balance weight.

It is provided a counter-roller active power flexible spinning device 100 for a large cylinder according to the present disclosure. The device includes a rack unit 1, a spindle unit 2, an outer roller unit 3, and an inner roller unit 4. The rack unit 1 includes a base 101, inner pillars 102, outer pillars 103 and an inner roller disk 104, the outer pillars 102 and the outer pillars 103 are both connected to the base 101, the distance between each outer pillar 103 and the center of the base 101 is greater than the distance between each inner pillar 102 and the center of the base 101, and the inner roller disk 104 is connected to one end, away from the base 101, of each inner pillar 102. The spindle unit 2 includes a spindle platform 201, a spindle turntable 202, a first driver 203, second drivers 204, and workpiece fixtures 205. The spindle platform 201 is slidingly connected to the inner pillars 102, the first driver 203 is fixed onto the base 101, and an output end of the first driver 203 is in transmission connection with the spindle platform 201. The spindle turntable 202 is slidingly connected to the spindle platform 201, the second drivers 204 are fixed onto the spindle platform 201, and output ends of the second drivers 204 are in transmission connection with the spindle turntable 202. The workpiece fixtures 205 are arranged on the spindle turntable 202, and the workpiece fixtures 205 can be configured to fix a blank to be formed. The outer roller unit 3 includes outer rollers 301, outer roller seats 302, third drivers 303, and fourth drivers 304. The outer rollers 301 are rotatably connected to the outer roller seats 302, the third drivers 303 are fixed onto the outer roller seats 302, and output ends of the third drivers 303 are in transmission connection with the outer rollers 301. The outer roller seats 302 are slidingly arranged on the outer pillars 103, a reciprocating sliding direction of each outer roller seat 302 is perpendicular to the rotation axis of the spindle turntable 202, and an extension line of a sliding route of each outer roller seat 302 has an intersection point with the axis of the spindle turntable 202. The fourth drivers 304 are fixed onto the outer pillars 103, and output ends of the fourth drivers 304 are in transmission connection with the outer roller seats 302. The inner roller unit 4 includes inner rollers 401, inner roller seats 402, fifth drivers 403, and sixth drivers 404. The inner rollers 401 are rotatably connected to the inner roller seats 402, the fifth drivers 403 are fixed onto the inner roller seats 402, output ends of the fifth drivers 403 are in transmission connection with the inner rollers 401, and the inner rollers 401 are in one-to-one correspondence with the outer rollers 301. The inner roller seats 402 are slidingly arranged on the inner roller disk 104, a reciprocating sliding direction of each inner roller seat 402 is perpendicular to the rotation axis of the spindle turntable 202, and an extension line of a sliding route of each inner roller seat 402 has an intersection point with the axis of the spindle turntable 202. The sixth drivers 404 are fixed onto the inner roller disk 104, and output ends of the sixth drivers 404 are in transmission connection with the inner roller seats 402.

According to the counter-roller active power flexible spinning device 100 for the large cylinder, the spindle turntable 202 of the spindle unit 2 can be configured to fix the blank to be formed. The second drivers 204 are configured to drive the spindle turntable 202 to rotate, thereby achieving the rotation of the cylinder blank. The first driver 203 is configured to drive the spindle turntable 202 to axially slide, and the spindle platform 201 can be configured to drive the spindle turntable 202 to axially move back and forth, so as to complete axial feeding. The inner pillars 102 provide a guidance for the axial reciprocating movement of the spindle platform 201. The third drivers 303 of the outer roller unit 3 drive the outer rollers 301 to rotate to spin the outside of the cylinder blank, and the fourth drivers 304 drive the outer roller seats 302 to radially slide back and forth on the outer pillars 103 along the spindle turntable 202, so as to complete the radial feeding of the outer rollers 301. The fifth drivers 403 of the inner roller unit 4 can drive the inner rollers 401 to rotate, so as to spin the inside of the cylinder blank, and the sixth drivers 404 drive the inner roller seats 402 to radially slide back and forth along the inner roller disk 104, thus performing the radial feeding of the inner rollers 401 during the processing. The outer pillars 103 of the rack unit 1 provide a stable support for the outer roller unit 3, the inner pillars 102 and the inner roller disk 104 provide a mounting basis for the spindle unit 2 and the inner roller unit 4, the inner pillars 102 and the outer pillars 103 are both connected to the base 101 to guarantee the structural stability of the rack unit 1. According to the counter-roller active power flexible spinning device 100 for the large cylinder, the axial feeding during the processing is achieved by using the spindle unit 2, and thus complex mechanical drive and transmission structures required by the axial movement of inner and outer spinning parts in the prior art are avoided, the processing and assembly difficulty and the production cost of the device are reduced, the problem of high difficulty in multi-axis decentralized synchronous control is solved, and the processing accuracy of the device is improved. Meanwhile, both the outer rollers 301 and the inner rollers 401 can actively rotate, thus improving the force consistency of inner and outer surfaces of the processed cylindrical part, increasing the single-pass thickness reduction rate, and avoiding the instability of the cylinder during the processing. The spindle unit 2, the outer roller unit 3 and the inner roller unit 4 are driven by separate drivers to achieve the feeding, on-line adjustment is convenient, the processing of various parts such as a variable-wall-thickness cylinder, a cylinder with circumferential ribs can be achieved, and the flexibility of the device is improved.

The spindle platform 201 is slidingly sleeved outside the inner pillars 102, and a sliding bearing is provided between the spindle platform 201 and each inner pillar 102 to make the spindle platform 201 reciprocate smoothly. In practical application, in order to improve structural stability and facilitate the mounting of the inner roller disk 104, multiple inner pillars 102 may be provided, and the inner pillars 102 are uniformly distributed circumferentially around the axis of the spindle platform 201. A spindle propulsion screw 206 is connected to the first driver 203, and the spindle propulsion screw 206 is rotatably provided between the base 101 and the inner roller disk 104. A spindle propulsion nut 207 is connected to the spindle platform 201, the spindle propulsion screw 206 is in threaded connection with the spindle propulsion nut 207, and the spindle propulsion screw 206 and the spindle propulsion nut 207 constitute a screw nut pair. The first driver 203 is configured to drive the spindle propulsion screw 206 to rotate, and then the spindle propulsion nut 207 is used to drive the spindle platform 201 to slide back and forth, and meanwhile, the inner roller disk 104 plays a role in limiting the extreme sliding position of the spindle platform 201. In order to improve the reciprocating motion accuracy and force uniformity of the spindle platform 201, multiple groups of spindle propulsion screws 206 and spindle propulsion nuts 207 may be provided.

In order to further improve the sliding accuracy of the spindle platform 201, one side, close to the inner pillar 102, of each outer pillar 103 is provided with a slide rail 105. The spindle platform 201 is provided with a slider 208 in fit with the slide rail 105, and the slider 208 is slidingly arranged on the slide rail 105, so as to improve the motion stability and reliability of the spindle platform 201.

Figure 4:
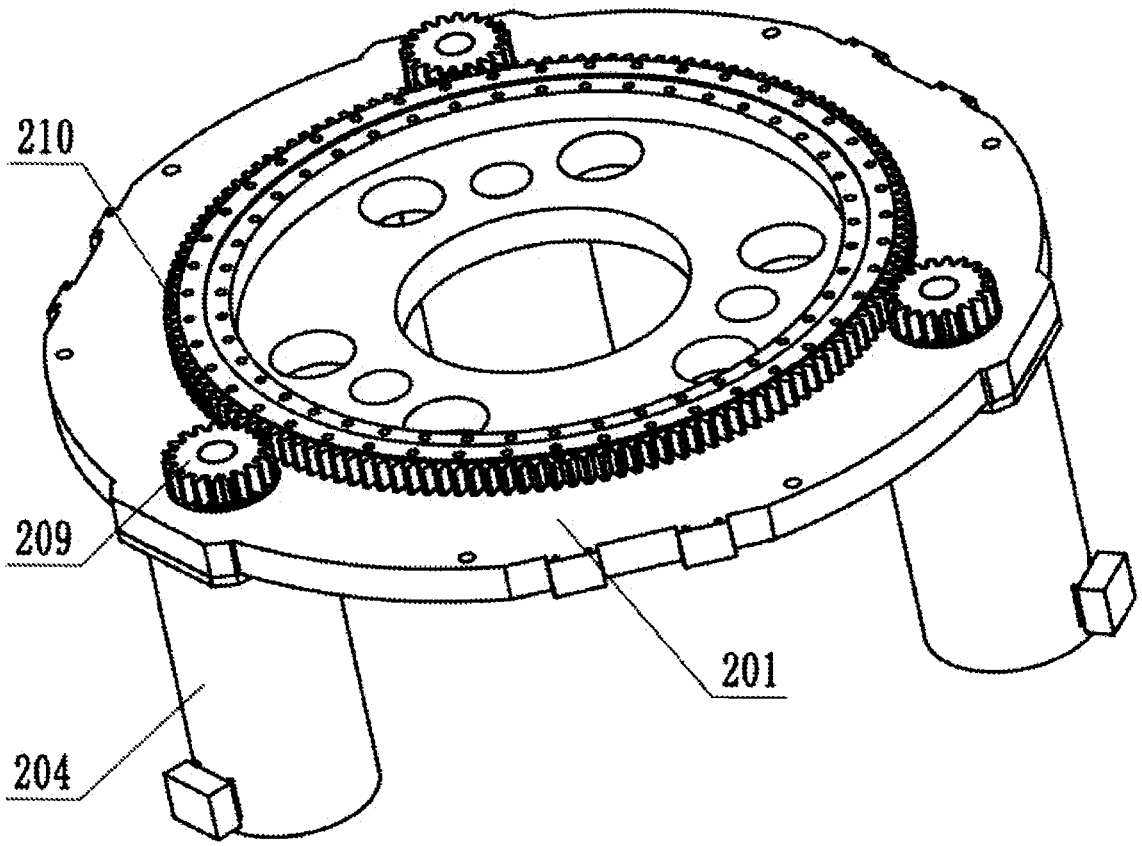
FIG. 4 is a partial structure schematic diagram of a spindle unit of a counter-roller active power flexible spinning device for a large cylinder in accordance with the present disclosure.
Figure 5:
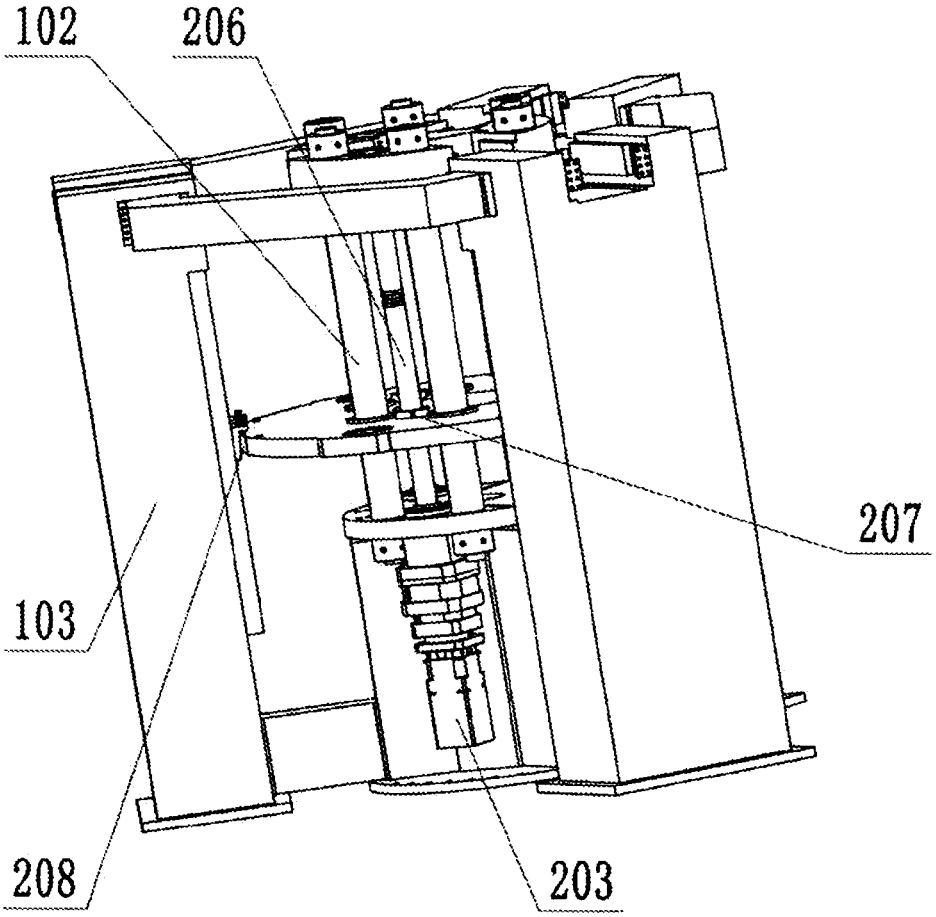
FIG. 5 is a structure schematic diagram of a spindle unit and a rack unit of a counter-roller active power flexible spinning device for a large cylinder in accordance with the present disclosure.
Figure 6:
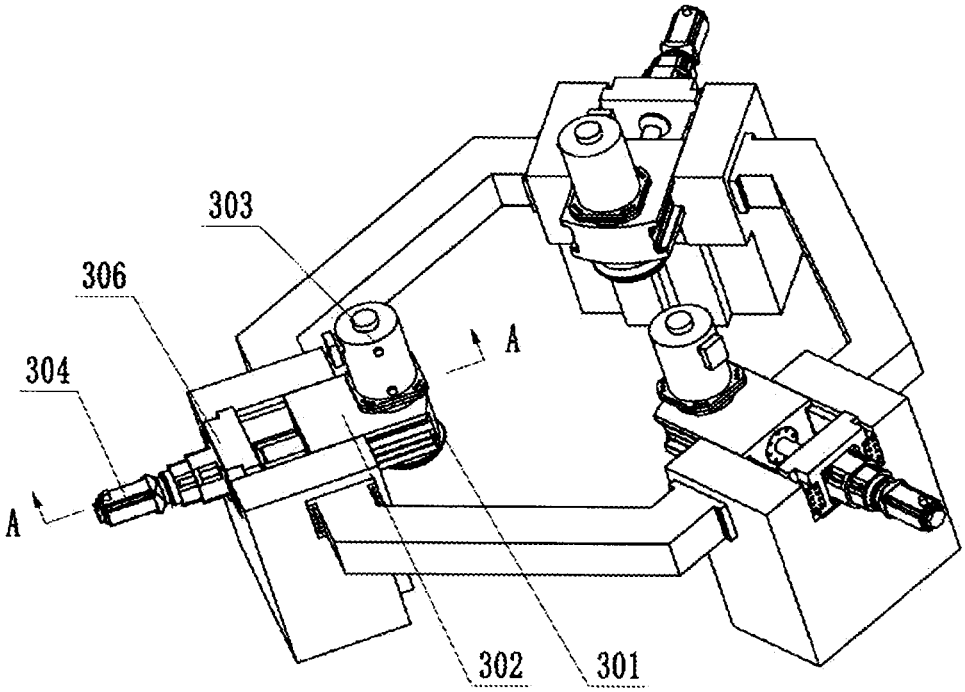
FIG. 6 is a structure schematic diagram of an outer roller unit of a counter-roller active power flexible spinning device for a large cylinder in accordance with the present disclosure.

Specifically, a driving gear 209 is connected to each second driver 204, and a transmission gear 210 is connected to the spindle turntable 202, please referring to FIG. 4 for details. The spindle turntable 202 and the transmission gear 210 are provided coaxially, the driving gear 209 is meshed with the transmission gear 210, and the second drivers 204 are configured to drive the transmission gear 210 to rotate by using the driving gear 209, thus driving the spindle turntable 202 to rotate. The spindle turntable is of an annular structure, each inner pillar 102 passes through a hollow portion of the spindle turntable 202, without affecting the rotation of the spindle turntable 202. Correspondingly, the transmission gear 210 is of a ring gear structure, and the transmission gear 210 and the spindle turntable 202 are provided coaxially, so as to drive the cylinder blank to rotate along its own axis. In this specific embodiment, three driving gears 209 are provided, the second drivers 204 are in one-to-one correspondence with the driving gears 209, and the driving gears 209 are uniformly distributed circumferentially around the axis of the transmission gear 210, thereby further improving the force uniformity and motion reliability of the spindle turntable 202.

Figure 3:
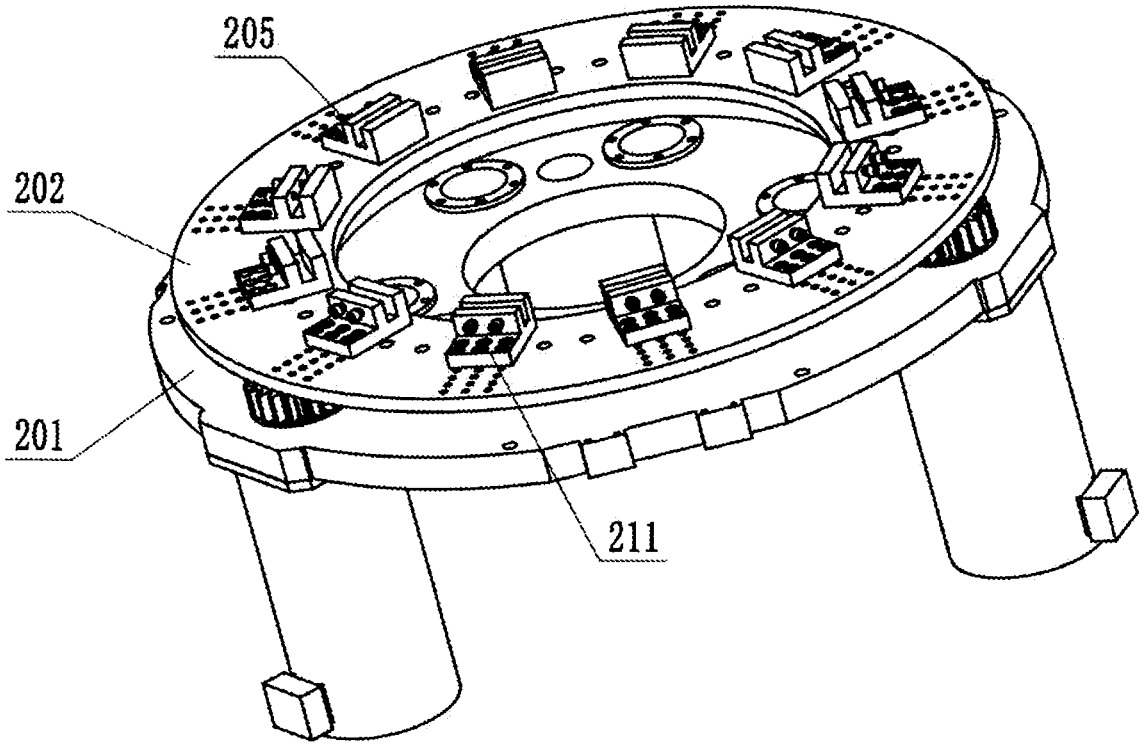
FIG. 3 is a structure schematic diagram of a spindle unit of a counter-roller active power flexible spinning device for a large cylinder in accordance with the present disclosure.

It should also be noted that, the workpiece fixtures 205 are connected to the spindle turntable 202 with fastening screws 211, please referring to FIG. 3, and the connection positions of the workpiece fixtures 205 and the spindle turntable 202 can be adjusted. Multiple screw holes in fit with the fastening screws 211 are arranged in a radial direction of the spindle turntable 202 to facilitate the adjustment of the relative positions of the workpiece fixtures 205 and the spindle turntable 202, so as to adapt to the fixing of cylinder blanks of different specifications and improve the flexibility and adaptability of the device. In order to ensure the clamping stability of the cylinder blank, multiple workpiece fixtures 205 are provided, and the workpiece fixtures 205 are uniformly distributed circumferentially around the axis of the spindle turntable 202, thereby improving the force uniformity of the cylinder blank and ensuring the clamping stability of the cylinder blank.

In this specific embodiment, the outer pillars 103 are provided with U-shaped through grooves 106, and the outer roller seats 302 are slidably arranged in the U-shaped through grooves 106. The inner roller disk 104 is provided with U-shaped grooves 107 in which the inner roller seats 402 are slidingly arranged, so as to guarantee the motion reliability of the outer roller seats 302 and the inner roller seats 402. In practical application, self-lubricating copper plates are provided between the outer roller seats 302 and the U-shaped through grooves 106 and between the inner roller seats 402 and the U-shaped grooves 107 to form sliding pairs, thereby ensuring the reciprocating sliding smoothness of the outer roller seats 302 and the inner roller seats 402, and improving the reliability of the radial feeding of the outer rollers 301 and the inner rollers 401.

Figure 7:
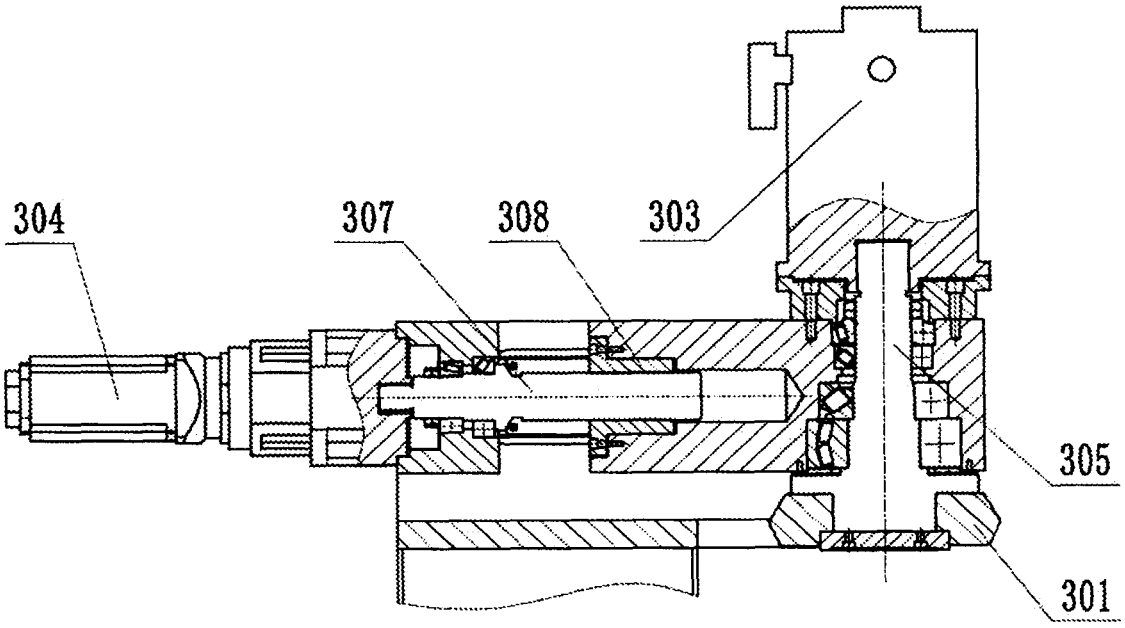
FIG. 7 is a schematic diagram of a section structure in an A-A direction in FIG. 6.
Figure 8:
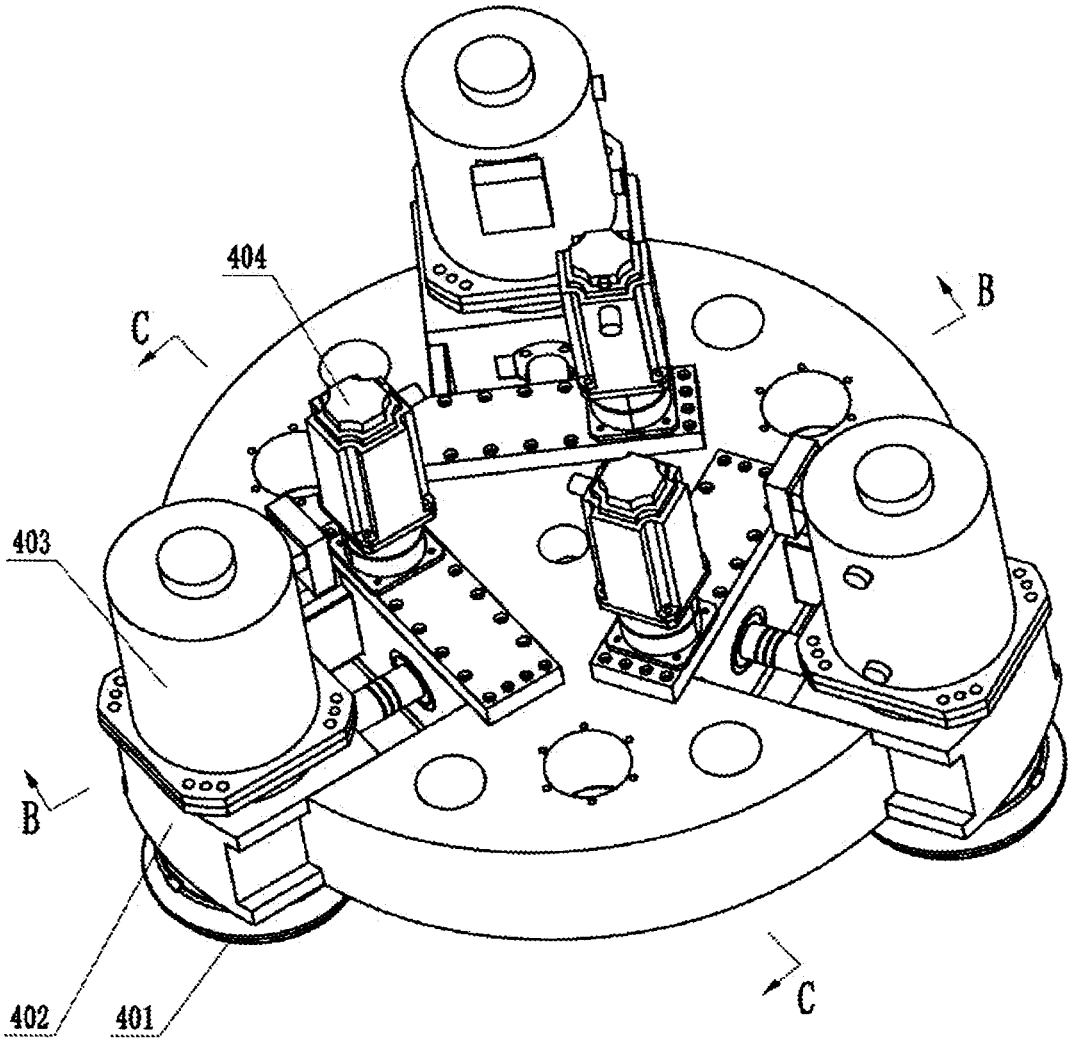
FIG. 8 is a structure schematic diagram of an inner roller unit of a counter-roller active power flexible spinning device for a large cylinder in accordance with the present disclosure.
Figure 9:
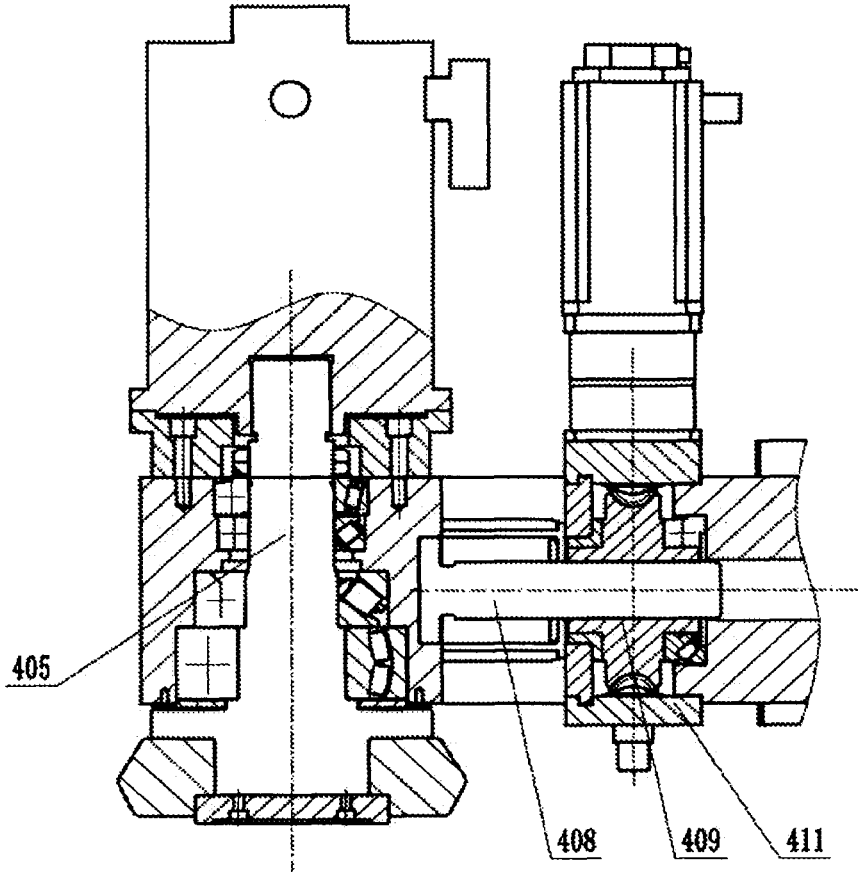
FIG. 9 is a schematic diagram of a section structure in a B-B direction in FIG. 6.
Figure 10:
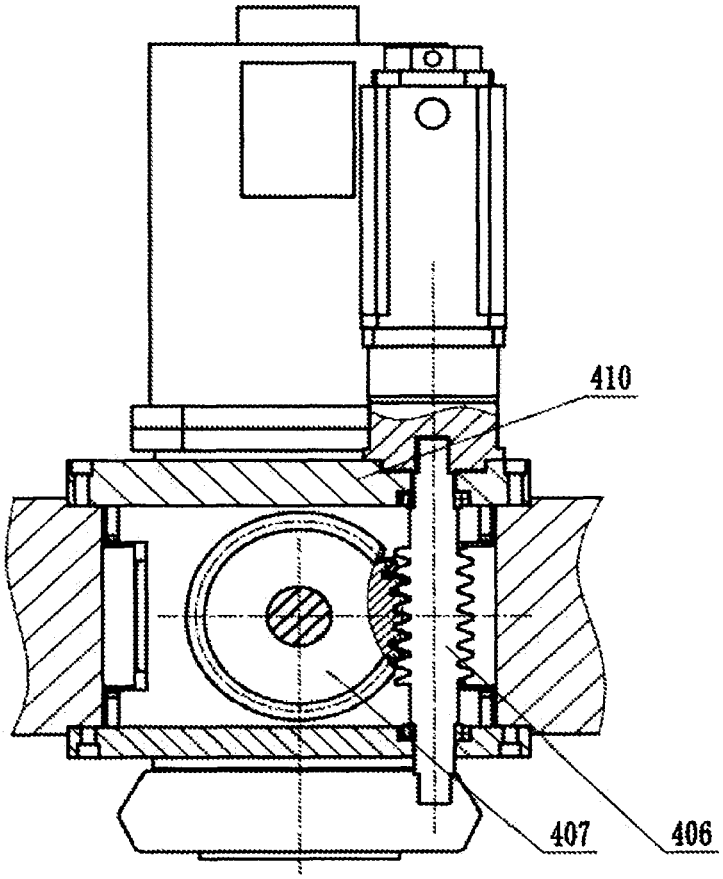
FIG. 10 is a schematic diagram of a section structure in a C-C direction in FIG. 6.

More specifically, an outer roller shaft 305 is connected to each outer roller 301, and the output end of each third driver 303 are connected to the outer roller shaft 305 by a spline, please referring to FIG. 7 for details, thus ensuring smooth transmission of torque. A stop 306 is connected to each fourth driver 304, and is fixed to each outer pillar 103. An outer roller feeding screw 307 is connected to the output end of each fourth driver 304, an outer roller feeding nut 308 is connected to each outer roller seat 302, and the outer roller feeding screw 307 is in threaded connection with the outer roller feeding nut 308. Each outer roller feeding screw 307 and each outer roller feeding nut 308 form a screw nut pair, thus ensuring the smooth transmission of the output torque of the fourth driver 304. A servo motor with a reducer can be used as the fourth driver 304, the outer roller feeding nut 308 can be embedded into the outer roller seat 302, thus saving the space occupied by parts. In practical application, the third driver 303 can be fixed above the outer roller seat 302 by using an outer roller motor mounting plate, so as to drive the outer roller 301 to rotate.

Accordingly, an inner roller shaft 405 is connected to each inner roller 401, and the output end of each fifth driver 403 is connected to the inner roller shaft 405 by a spline, the connection is convenient, and thus the torque can be smoothly transmitted. An inner roller feeding worm 406 is connected to the output end of each sixth driver 404, one end, away from the sixth driver 404, of the inner roller feeding worm 406 is rotatably connected to the inner roller disk 104, an inner roller feeding worm gear 407 is also connected to the inner roller disk 104, and the inner roller feeding worm gear 407 is rotatably connected to the inner roller disk 104. Each six driver 404 drives the inner roller feeding worm gear 407 to rotate by using the inner roller feeding worm 406, the inner roller feeding worm gear 407 is connected with an inner roller feeding nut 409 and is configured to drive the inner roller feeding nut 409 to rotate. An inner roller feeding screw 408 is connected to each inner roller seat 402, the inner roller feeding screw 408 and the inner roller feeding nut 409 are in threaded connection to form a screw nut pair, and then the inner roller feeding nut 409 is used to drive the inner roller feeding screw 408 to move, thus making the inner roller seat 402 to slide back and forth to achieve the purpose of radial feeding. The inner roller feeding nut 409 is embedded into an inner ring of the inner roller feeding worm gear 407, the inner roller feeding worm gear 407 and the inner roller feeding nut 409 are an integrated part, thus saving the space occupied by the mechanism and achieving power transmission in the limited space. In addition, it also should be noted that a servo motor with a reducer may also be used as the sixth driver 404. The reducer and the servo motor are fixedly mounted on the inner roller disk 104 by using an upper cover plate 410 and a lower cover plate 411. The fifth driver 403 can be fixed above the inner roller seat 402 by using a motor mounting plate, so as to drive the inner roller 401 to rotate actively.

In addition, the rack unit 1 also includes an upper connecting beam 108 and a lower connecting beam 109. The outer pillars 103 are connected to the base 101 by using the lower connecting beam 109, and adjacent outer pillars 103 are connected by using the upper connecting beam 108, thus improving the structural strength of the rack unit 1 and ensuring the overall structural stability of the device. The inner pillars 102 are fixed by fastening nuts 110 after passing through the inner roller disk 104, thus being convenient for disassembly, assembly and maintenance. The rack unit 1 is of a cage structure, which further improves the structural integrity of the rack unit 1 on the premise of ensuring the structural strength of the rack unit 1.

Figure 11:
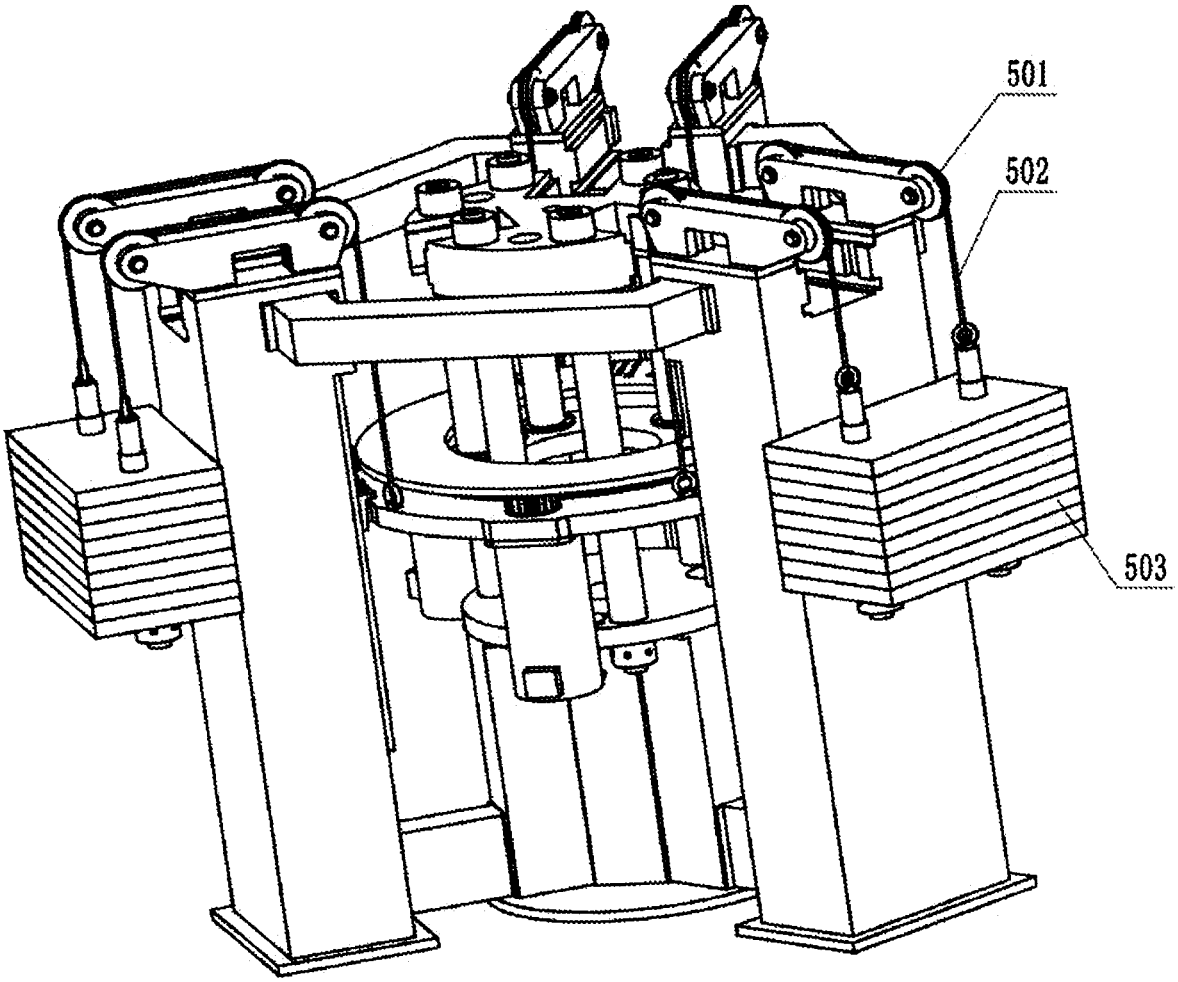
FIG. 11 is a structure schematic diagram of a balance unit of a counter-roller active power flexible spinning device for a large cylinder in accordance with the present disclosure.

Further, the counter-roller active power flexible spinning device 100 for the large cylinder further includes balance units 5, please refer to FIG. 11. Each balance unit 5 includes a pulley block 501, a steel cable 502, and a balance weight 503. The pulley block 501 is arranged on the outer pillar 103, one end of the steel cable 502 is connected to the spindle platform 201 by a lifting ring, and the other end of the steel cable 502 is connected to the balance weight 503 after bypassing the pulley block 501 for balancing the dead weight of the spindle unit 2, and thus the structural stability and operating reliability of the device are further improved, the overall rigidity of the device is guaranteed, and the forming accuracy of the cylindrical part is improved. In practical application, the number of the balance weights 503 can be adjusted according to the weight of the blank to be processed, so as to adapt to the processing of various specifications of cylindrical parts. Accordingly, the number of the balance units 5 may coincide with the number of the outer pillars 103 or be set according to actual needs, and multiple balance units 5 may be uniformly arranged circumferentially around the axis of the spindle platform 201, so as to ensure the force uniformity of the spindle platform 201.

According to the counter-roller active power flexible spinning device 100 for the large cylinder, the spindle unit 2 is used to replace the inner and outer roller axial feeding system of the existing counter-roller power flexible spinning device, a complex mechanical drive and transmission system required by the axial movement of the inner and outer rollers is avoided, the design, processing and assembly difficulty and the device cost are reduced, the problem of multi-axis decentralized synchronous control is avoided, and the processing accuracy of the device is improved. Meanwhile, by using a mode of axially fixing the outer roller unit 3 and the inner roller unit 4, the axial force received by the device in the processing of the cylindrical part is balanced through pre-tightening pillars of the machine, the rigidity of the device is improved, and the forming accuracy of the cylinder is increased. In addition, a servo motor is used to drive the radial feeding of the inner rollers 401 and the outer rollers 301, the inner rollers 401 and the outer rollers 301 can be adjusted online during the processing, thus achieving the processing of various parts such as a variable-wall-thickness cylinder, and a cylinder with circumferential ribs, and improving the flexibility of the device.

Several examples are used for illustration of the principles and implementation methods of the present disclosure. The description of the embodiments is merely used to help illustrate the method and its core principles of the present disclosure. In addition, those of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A counter-roller active power flexible spinning device for a large cylinder, comprising:

a rack unit, comprising a base, inner pillars, outer pillars, and an inner roller disk, wherein the inner pillars and the outer pillars are both connected to the base, a distance between each outer pillar and a center of the base is greater than that between each inner pillar and the center of the base, and the inner roller disk is connected to one end, away from the base, of each inner pillar;

a spindle unit, comprising a spindle platform, a spindle turntable, a first driver, second drivers, and workpiece fixtures, wherein the spindle platform is slidably connected to the inner pillars, the first driver is fixed onto the base, an output end of the first driver is in transmission connection with the spindle platform, the spindle turntable is rotatably connected to the spindle platform, the second drivers are fixed onto the spindle platform, output ends of the second drivers are in transmission connection with the spindle turntable, the workpiece fixtures are arranged on the spindle turntable, and the workpiece fixtures are able to fix a blank to be formed;

an outer roller unit, comprising outer rollers, outer roller seats, third drivers, and fourth drivers, wherein the outer rollers are rotatably connected to the outer roller seats, the third drivers are fixed onto the outer roller seats, and output ends of the third drivers are in transmission connection with the outer rollers; the outer roller seats are slidingly arranged on the outer pillars; a reciprocating sliding direction of each outer roller seat is perpendicular to the rotation axis of the spindle turntable, and an extension line of a sliding route of each outer roller seat has an intersection point with the axis of the spindle turntable; the fourth drivers are fixed onto the outer pillars, and output ends of the fourth drivers are in transmission connection with the outer roller seats; and an inner roller unit, comprising inner rollers, inner roller seats, fifth drivers, and sixth drivers, wherein the inner rollers are rotatably connected to the inner roller seats, the fifth drivers are fixed onto the inner roller seats, output ends of the fifth drivers are in transmission connection with the inner rollers, and the inner rollers are in one-to-one correspondence with the outer rollers; the inner roller seats are slidingly arranged on the inner roller disk; a reciprocating sliding direction of each inner roller seat is perpendicular to the rotation axis of the spindle turntable, and an extension line of a sliding route of each inner roller seat has an intersection point with the axis of the spindle turntable; the sixth drivers are fixed onto the inner roller disk, and output ends of the sixth drivers are in transmission connection with the inner roller seats;

wherein:

the outer pillars are provided with U-shaped through grooves;

the outer roller seats are slidably arranged in the U-shaped through grooves;

the inner roller disk is provided with U-shaped grooves in which the inner roller seats are slidably arranged; and self-lubricating copper plates are provided:

between the outer roller seats and the U-shaped through grooves of the outer pillars; and between the inner roller seats and the U-shaped grooves of the inner roller disk.

2. The counter-roller active power flexible spinning device for a large cylinder according to claim 1, wherein the spindle platform is slidingly sleeved outside the inner pillars, and a sliding bearing is provided between the spindle platform and each inner pillar; a spindle propulsion screw is connected to the first driver, and the spindle propulsion screw is rotatably provided between the base and the inner roller disk; a spindle propulsion nut is connected to the spindle platform, and the spindle propulsion screw is in threaded connection with the spindle propulsion nut.

3. The counter-roller active power flexible spinning device for a large cylinder according to claim 1, wherein one side, close to the inner pillar, of each outer pillar is provided with a slide rail, the spindle platform is provided with a slider in fit with the slide rail, and the slider is slidably arranged on the slide rail.

4. The counter-roller active power flexible spinning device for a large cylinder according to claim 1, wherein a driving gear is connected to each second driver, a transmission gear is connected to the spindle turntable, the spindle turntable and the transmission gear are provided coaxially, and the driving gear is meshed with the transmission gear; a plurality of driving gears are provided, the second drivers are in one-to-one correspondence with the driving gears, and the driving gears are uniformly distributed circumferentially around the axis of the transmission gear.

5. The counter-roller active power flexible spinning device for a large cylinder according to claim 1, wherein the workpiece fixtures are connected to the spindle turntable by fastening screws, and the connecting positions of the workpiece fixtures and the spindle turntable are adjustable; a plurality of workpiece fixtures are provided, and the workpiece fixtures are uniformly distributed circumferentially around the axis of the spindle turntable.

6. The counter-roller active power flexible spinning device for a large cylinder according to claim 1, wherein an outer roller shaft is connected to each outer roller, and the output end of each third driver is connected to the outer roller shaft by a spline; a stop is connected to each fourth driver, and is fixed onto the outer pillar; an outer roller feeding screw is connected to the output ends of each fourth driver, an outer roller feeding nut is connected to the outer roller seat, and the outer roller feeding screw is in threaded connection with the outer roller feeding nut.

7. The counter-roller active power flexible spinning device for a large cylinder according to claim 1, wherein an inner roller shaft is connected to each inner roller, and the output end of each fifth driver is connected to the inner roller shaft by a spline; an inner roller feeding worm is connected to the output end of each sixth driver, and one end, away from the sixth driver, of the inner roller feeding worm is rotatably connected to the inner roller disk; an inner roller feeding worm gear is further connected to the inner roller disk, the inner roller feeding worm gear is rotatably connected to the inner roller disk, an inner roller feeding nut is connected to the inner roller feeding worm gear, an inner roller feeding screw is connected to each inner roller seat, and the inner roller feeding screw is in threaded connection with the inner roller feeding nut.

8. The counter-roller active power flexible spinning device for a large cylinder according to claim 1, wherein the rack unit further comprises an upper connecting beam and a lower connecting beam, the outer pillars are connected to the base by using the lower connecting beam, and adjacent outer pillars are connected by using the upper connecting beam; the inner pillars pass through the inner roller disk and then are fixed by fastening nuts, and the rack unit is of a cage structure.

9. The counter-roller active power flexible spinning device for a large cylinder according to claim 1, further comprising balance units, wherein each of the balance units comprises a pulley block, a steel cable and a balance weight; the pulley block is arranged on the outer pillar, one end of the steel cable is connected to the spindle platform, and the other end of the steel cable is connected to the balance weight by bypassing the pulley block.

10. The counter-roller active power flexible spinning device for a large cylinder according to claim 2, further comprising balance units, wherein each of the balance units comprises a pulley block, a steel cable and a balance weight; the pulley block is arranged on the outer pillar, one end of the steel cable is connected to the spindle platform, and the other end of the steel cable is connected to the balance weight by bypassing the pulley block.

11. The counter-roller active power flexible spinning device for a large cylinder according to claim 3, further comprising balance units, wherein each of the balance units comprises a pulley block, a steel cable and a balance weight; the pulley block is arranged on the outer pillar, one end of the steel cable is connected to the spindle platform, and the other end of the steel cable is connected to the balance weight by bypassing the pulley block.

12. The counter-roller active power flexible spinning device for a large cylinder according to claim 4, further comprising balance units, wherein each of the balance units comprises a pulley block, a steel cable and a balance weight; the pulley block is arranged on the outer pillar, one end of the steel cable is connected to the spindle platform, and the other end of the steel cable is connected to the balance weight by bypassing the pulley block.

13. The counter-roller active power flexible spinning device for a large cylinder according to claim 5, further comprising balance units, wherein each of the balance units comprises a pulley block, a steel cable and a balance weight; the pulley block is arranged on the outer pillar, one end of the steel cable is connected to the spindle platform, and the other end of the steel cable is connected to the balance weight by bypassing the pulley block.

14. The counter-roller active power flexible spinning device for a large cylinder according to claim 6, further comprising balance units, wherein each of the balance units comprises a pulley block, a steel cable and a balance weight; the pulley block is arranged on the outer pillar, one end of the steel cable is connected to the spindle platform, and the other end of the steel cable is connected to the balance weight by bypassing the pulley block.

15. The counter-roller active power flexible spinning device for a large cylinder according to claim 7, further comprising balance units, wherein each of the balance units comprises a pulley block, a steel cable and a balance weight; the pulley block is arranged on the outer pillar, one end of the steel cable is connected to the spindle platform, and the other end of the steel cable is connected to the balance weight by bypassing the pulley block.

16. The counter-roller active power flexible spinning device for a large cylinder according to claim 8, further comprising balance units, wherein each of the balance units comprises a pulley block, a steel cable and a balance weight; the pulley block is arranged on the outer pillar, one end of the steel cable is connected to the spindle platform, and the other end of the steel cable is connected to the balance weight by bypassing the pulley block.

17. A counter-roller active power flexible spinning device for a large cylinder, comprising:

a rack unit, comprising a base, inner pillars, outer pillars, and an inner roller disk, wherein the inner pillars and the outer pillars are both connected to the base, a distance between each outer pillar and a center of the base is greater than that between each inner pillar and the center of the base, and the inner roller disk is connected to one end, away from the base, of each inner pillar;

a spindle unit, comprising a spindle platform, a spindle turntable, a first driver, second drivers, and workpiece fixtures, wherein the spindle platform is slidably connected to the inner pillars, the first driver is fixed onto the base, an output end of the first driver is in transmission connection with the spindle platform, the spindle turntable is rotatably connected to the spindle platform, the second drivers are fixed onto the spindle platform, output ends of the second drivers are in transmission connection with the spindle turntable, the workpiece fixtures are arranged on the spindle turntable, and the workpiece fixtures are able to fix a blank to be formed;

an outer roller unit, comprising outer rollers, outer roller seats, third drivers, and fourth drivers, wherein the outer rollers are rotatably connected to the outer roller seats, the third drivers are fixed onto the outer roller seats, and output ends of the third drivers are in transmission connection with the outer rollers; the outer roller seats are slidingly arranged on the outer pillars; a reciprocating sliding direction of each outer roller seat is perpendicular to the rotation axis of the spindle turntable, and an extension line of a sliding route of each outer roller seat has an intersection point with the axis of the spindle turntable; the fourth drivers are fixed onto the outer pillars, and output ends of the fourth drivers are in transmission connection with the outer roller seats; and an inner roller unit, comprising inner rollers, inner roller seats, fifth drivers, and sixth drivers, wherein the inner rollers are rotatably connected to the inner roller seats, the fifth drivers are fixed onto the inner roller seats, output ends of the fifth drivers are in transmission connection with the inner rollers, and the inner rollers are in one-to-one correspondence with the outer rollers; the inner roller seats are slidingly arranged on the inner roller disk; a reciprocating sliding direction of each inner roller seat is perpendicular to the rotation axis of the spindle turntable, and an extension line of a sliding route of each inner roller seat has an intersection point with the axis of the spindle turntable; the sixth drivers are fixed onto the inner roller disk, and output ends of the sixth drivers are in transmission connection with the inner roller seats;

wherein:

an outer roller shaft is connected to each outer roller;

the output end of each third driver is connected to the outer roller shaft by a spline;

a stop is connected to each fourth driver and is fixed onto the outer pillar;

an outer roller feeding screw is connected to the output ends of each fourth driver;

an outer roller feeding nut is connected to the outer roller seat; and the outer roller feeding screw is in threaded connection with the outer roller feeding nut.

18. A counter-roller active power flexible spinning device for a large cylinder, comprising:

a rack unit, comprising a base, inner pillars, outer pillars, and an inner roller disk, wherein the inner pillars and the outer pillars are both connected to the base, a distance between each outer pillar and a center of the base is greater than that between each inner pillar and the center of the base, and the inner roller disk is connected to one end, away from the base, of each inner pillar;

a spindle unit, comprising a spindle platform, a spindle turntable, a first driver, second drivers, and workpiece fixtures, wherein the spindle platform is slidably connected to the inner pillars, the first driver is fixed onto the base, an output end of the first driver is in transmission connection with the spindle platform, the spindle turntable is rotatably connected to the spindle platform, the second drivers are fixed onto the spindle platform, output ends of the second drivers are in transmission connection with the spindle turntable, the workpiece fixtures are arranged on the spindle turntable, and the workpiece fixtures are able to fix a blank to be formed;

an outer roller unit, comprising outer rollers, outer roller seats, third drivers, and fourth drivers, wherein the outer rollers are rotatably connected to the outer roller seats, the third drivers are fixed onto the outer roller seats, and output ends of the third drivers are in transmission connection with the outer rollers; the outer roller seats are slidingly arranged on the outer pillars; a reciprocating sliding direction of each outer roller seat is perpendicular to the rotation axis of the spindle turntable, and an extension line of a sliding route of each outer roller seat has an intersection point with the axis of the spindle turntable; the fourth drivers are fixed onto the outer pillars, and output ends of the fourth drivers are in transmission connection with the outer roller seats; and an inner roller unit, comprising inner rollers, inner roller seats, fifth drivers, and sixth drivers, wherein the inner rollers are rotatably connected to the inner roller seats, the fifth drivers are fixed onto the inner roller seats, output ends of the fifth drivers are in transmission connection with the inner rollers, and the inner rollers are in one-to-one correspondence with the outer rollers; the inner roller seats are slidingly arranged on the inner roller disk; a reciprocating sliding direction of each inner roller seat is perpendicular to the rotation axis of the spindle turntable, and an extension line of a sliding route of each inner roller seat has an intersection point with the axis of the spindle turntable; the sixth drivers are fixed onto the inner roller disk, and output ends of the sixth drivers are in transmission connection with the inner roller seats;

wherein:

an inner roller shaft is connected to each inner roller;

the output end of each fifth driver is connected to the inner roller shaft by a spline;

an inner roller feeding worm is connected to the output end of each sixth driver;

one end, away from the sixth driver, of the inner roller feeding worm is rotatably connected to the inner roller disk;

an inner roller feeding worm gear is further connected to the inner roller disk;

the inner roller feeding worm gear is rotatably connected to the inner roller disk;

an inner roller feeding nut is connected to the inner roller feeding worm gear;

an inner roller feeding screw is connected to each inner roller seat; and the inner roller feeding screw is in threaded connection with the inner roller feeding nut.

* * * * *